US006905805B2

(12) United States Patent
Sata et al.

(10) Patent No.: US 6,905,805 B2
(45) **Date of Patent: *Jun. 14, 2005**

(54) NONMAGNETIC BLACK TONER

(75) Inventors: Shinichi Sata, Wakayama (JP); Jun Shimizu, Wakayama (JP)

(73) Assignee: Kao Corporation, Tokyo (JP)

( * ) Notice: Subject to any disclaimer, the term of this patent is extended or adjusted under 35 U.S.C. 154(b) by 48 days.

This patent is subject to a terminal disclaimer.

(21) Appl. No.: 10/303,851

(22) Filed: Nov. 26, 2002

(65) Prior Publication Data

US 2003/0104299 A1 Jun. 5, 2003

(30) Foreign Application Priority Data

Nov. 29, 2001 (JP) ..... 2001-365064
Oct. 4, 2002 (JP) ..... 2002-292106

(51) Int. Cl.[7] ..... G03G 9/00

(52) U.S. Cl. ..... 430/108.6; 430/108.7; 430/111.4; 430/120

(58) Field of Search ..... 430/108.6, 108.7, 430/111.4, 120

(56) References Cited

U.S. PATENT DOCUMENTS 5,776,646 A 7/1998 Hagi et al.
5,827,632 A * 10/1998 Inaba et al. ..... 430/108.6
6,248,492 B1 * 6/2001 Tavernier et al. ..... 430/108.6
6,338,929 B1 * 1/2002 Hagi et al. ..... 430/108.6
2001/0031415 A1 * 10/2001 Ito ..... 430/108.6
2002/0076635 A1 6/2002 Yoshino et al.
2002/0177059 A1 * 11/2002 Sata et al. ..... 430/108.6
2003/0017405 A1 * 1/2003 Shimizu et al. ..... 430/108.6
2003/0054276 A1 * 3/2003 Moriyama et al. ..... 430/108.6
2003/0059699 A1 * 3/2003 Tachi et al. ..... 430/108.6
2003/0073018 A1 * 4/2003 Tachi et al. ..... 430/108.6
2003/0099890 A1 * 5/2003 Sata et al. ..... 430/108.6

OTHER PUBLICATIONS

SICOCER F Technical Information, Black 2904 (May 2000) pp. 1, 2, 18, 19.*
Patent Abstracts of Japan, JP 2001–100452, Jan. 15, 2002, (with corr. US 6,338,929).
Patent Abstracts of Japan, JP 10–10772, Jan. 16, 1998, (with. corr. US 5,776,646).
U.S. Appl. No. 10/303,851, filed Nov. 26, 2002, Sata et al.

* cited by examiner

*Primary Examiner*—Christopher RoDee
(74) *Attorney, Agent, or Firm*—Oblon, Spivak, McClelland, Maier & Neustadt, P.C.

(57) ABSTRACT

A nonmagnetic black toner comprising a resin binder, a black colorant comprising a metal oxide, and externally-added fine particles having an average particle size of 20 nm to 2.1 $\mu$m, wherein the fine particles are contained in the toner in an amount of 0.2% by weight or more. The nonmagnetic black toner can be used for the development of a latent image formed in electrophotography, electrostatic recording method, electrostatic printing method or the like.

7 Claims, No Drawings

NONMAGNETIC BLACK TONER

BACKGROUND OF THE INVENTION

1. Field of the Invention

The present invention relates to a nonmagnetic black toner used for the development of a latent image formed in electrophotography, electrostatic recording method, electrostatic printing method or the like.

2. Discussion of the Related Art

Conventionally, carbon blacks have been used as a black colorant for a toner. However, the carbon blacks have some defects such that the volume specific resistance is low, so that triboelectric charges required for development cannot be maintained, whereby a sufficient degree of blackness cannot be obtained. In addition, there are also pointed out some problems in safety hygiene. Therefore, various metal oxides have been proposed as black colorants used in place of carbon black [Japanese Patent Laid-Open No. 2000-10344 (claim 1 and the like), Japanese Patent Laid-Open No. Hei 9-25126 (claim 1 and the like), and the like].

However, toners comprising metal oxides cause drastic wear of photoconductor, and this tendency is markedly exhibited especially in a contact development-type apparatus.

An object of the present invention is to provide a nonmagnetic black toner which comprises a metal oxide as a black colorant but can reduce wear of photoconductor.

These and other objects of the present invention will be apparent from the following description.

SUMMARY OF THE INVENTION

The present invention is directed to the followings:

(1) a nonmagnetic black toner comprising:

a resin binder, a black colorant comprising a metal oxide, and externally-added fine particles having an average particle size of 20 nm to 2.1 $\mu$m, wherein the fine particles are contained in the toner in an amount of 0.2% by weight or more; and (2) a process for development of a toner, comprising applying the nonmagnetic black toner of item (1) above to an electrophotographic system in which a developing member is in contact with a photoconductor.

DETAILED DESCRIPTION OF THE INVENTION

One of the features of the toner of the present invention resides in that a metal oxide is used together with an external additive having a relatively large particle size. Generally, when a toner comprising a metal oxide is used, the photoconductor is likely to be worn. However, in the present invention, wear of photoconductor is considerably reduced by using an external additive having a large particle size. Conventionally, it has been a common knowledge among those skilled in the art that an external additive having a large particle size causes wear of photoconductor when toners comprising carbon black are used (Japanese Patent Laid-Open Nos. 2001-100452, Hei 10-10772 and the like). However, there are surprising findings that an effect of reducing wear of photoconductor is exhibited when a metal oxide is used, nevertheless an external additive having a large particle size is used.

The metal oxide in the present invention may be oxides of any metal, and it is preferable that the metal oxide is constituted by an oxide of a metal which belongs to Group 2, 13 or 14 of the Third Period or Groups 3 to 11 of the Fourth Period of the Periodic Table, from the viewpoint of the degree of blackness of the toner. Magnesium (Mg), aluminum (Al) and silicon (Si) belong to Groups 2, 13 and 14 of the Third Period of the Periodic Table, and scandium (Sc), titanium (Ti), vanadium (V), chromium (Cr), manganese (Mn), iron (Fe), cobalt (Co), nickel (Ni) and copper (Cu) belong to Groups 3 to 11 of the Fourth Period of the Periodic Table. Among them, Mg, Al, Ti, Mn, Fe and Cu are preferable, and Mg, Al, Mn, Fe and Cu are especially preferable. Further, the metal oxide is preferably a metal oxide constituted by at least 2 metals, and it is preferable that at least one, preferably at least two, more preferably at least three of the metals belong to Group 2, 13 or 14 of the Third Period or Groups 3 to 11 of the Fourth Period of the Periodic Table. The compositional ratio of the metals in the metal oxide is not particularly limited.

From the viewpoints of adjusting the affinity between the metal oxide and the resin binder and increasing the dispersibility of the metal oxide, the metal oxide in the present invention has an oil absorption per unit area of preferably 0.07 ml/m$^2$ or less, more preferably from 0.0001 to 0.05 ml/m$^2$, especially preferably from 0.001 to 0.02 ml/m$^2$. In the present invention, the above-mentioned oil absorption (ml/m$^2$) is calculated by the following equation using the oil absorption (ml/100 g) as determined by the method according to JIS K5101 and the specific surface area (m$^2$/100 g):

$$\text{Oil Absorption Per Unit Area} = \frac{\text{Oil Absorption (ml/100 g)}}{\text{Specific Surface Area (m}^2\text{/100 g)}}\,(\text{ml/m}^2)$$

The metal oxide has an average particle size of preferably from 5 nm to 1 $\mu$m, more preferably from 5 to 500 nm, especially preferably from 5 to 300 nm, from the viewpoints of the oil absorption and the covering strength.

The process for preparing a metal oxide includes a process comprising depositing other oxide on a surface of the main oxide used as a core particle (Japanese Patent Laid-Open No. 2000-10344), a process of making a metal oxide comprising sintering several oxides (Japanese Patent Laid-Open No. Hei 9-25126), and the like, without being particularly limited thereto.

The preferable commercially available metal oxide in the present invention includes "Dye Pyroxide Black No. 1" (commercially available from DAINICHISEIKA COLOR & CHEMICALS MFG. CO., LTD., major metals contained: Cu, Mn, Fe), "Dye Pyroxide Black No. 2" (commercially available from DAINICHISEIKA COLOR & CHEMICALS MFG. CO., LTD., major metals contained: Fe, Mn, Cu), "HSB-603Rx," (commercially available from Toda Kogyo Corp., major metals contained: Mn, Fe), "HSB-605" commercially available from Toda Kogyo Corp., major metals contained: Fe, Mn), "ETB-100" (commercially available from Titan Kogyo K.K., major metals contained: Ti, Fe), "MC-3" (commercially available from MITSUI MINING & SMELTING CO., LTD., major metals contained: Fe, Mn, Cu), "MC-6" (commercially available from MITSUI MINING & SMELTING CO., LTD., major metals contained: Fe, Mn), "MC-7" (commercially available from MITSUI MINING & SMELTING CO., LTD., major metals contained: Fe, Mn), "MC-10" (commercially available from MITSUI MINING & SMELTING CO., LTD., major metals contained: Mg, Al, Fe), and the like.

The content of the metal oxide is preferably from 1 to 30 parts by weight, more preferably from 5 to 20 parts by weight, especially preferably from 8 to 20 parts by weight, based on 100 parts by weight of resin binder, from the viewpoints of the degree of blackness and the specific gravity of the toner.

The average particle size of fine particles externally added to the toner is from 20 nm to 2.1 μm, preferably from 30 nm to 1.8 μm, more preferably from 30 to 50 nm, in order to obtain the effect of preventing wear of photoconductor.

The fine particles include inorganic fine particles of silica, alumina, titania, zirconia, tin oxide, zinc oxide and the like, and organic fine particles of a polytetrafluoroethylene, a styrene(St)-methyl methacrylate(MMA) copolymer, an St-butyl acrylate(BA) copolymer, an MMA-BA copolymer and the like. Among them, from the viewpoint of reducing the wear of photoconductor, inorganic fine particles are preferable, an oxide containing at least one metal selected from the group consisting of silicon (Si), titanium (Ti) and aluminum (Al), such as silica, alumina and titania, is more preferable, and silica is especially preferable.

Further, it is preferable that the fine particles are subjected to hydrophobic treatment, from the viewpoint of the stability in environmental resistance. The method of hydrophobic treatment is not particularly limited. The agent for hydrophobic treatment includes hexamethyldisilazane, dimethyldichlorosilane, dimethylsiloxane, silicone oil, methyltriethoxysilane, and the like. Among them, hexamethyldisilazane and dimethyldichlorosilane are preferable. It is preferable that the amount of the agent for hydrophobic treatment is from 1 to 7 $mg/m^2$ per surface area of the silica.

The fine particles having an average particle size of 20 nm to 2.1 μm is contained in the toner in an amount of 0.2% by weight or more, preferably from 0.2 to 3% by weight, more preferably from 0.8 to 2% by weight.

Further, in the present invention, it is preferable that a silica having a small particle size is externally added in addition to the fine particles having a large particle size. The silica having a small particle size has an average particle size of preferably less than 20 nm, more preferably from 8 to 16 nm. By using the above silica having a small particle size together with fine particles having a large particle size, the flowability of the toner becomes excellent, so that wear of photoconductor is further reduced.

The content of the silica having a small particle size is preferably from 10 to 300 parts by weight, more preferably from 50 to 200 parts by weight, based on 100 parts by weight of the fine particles having a large particle size.

The resin binder in the present invention includes polyesters, styrene-acrylic resins, hybrid resins, epoxy resins, polycarbonates, polyurethanes, and the like, without being particularly limited thereto. Among them, from the viewpoints of the dispersibility of the colorant and the transferability, the polyester is preferable. The content of the polyester is preferably from 50 to 100% by weight, more preferably from 80 to 100% by weight, especially preferably 100% by weight, of the resin binder.

The raw material monomer for the polyester includes dihydric or higher polyhydric alcohols and dicarboxylic or higher polycarboxylic acid compounds.

The dihydric alcohol includes alkylene oxide adducts of bisphenol A such as polyoxypropylene(2.2)-2,2-bis(4-hydroxyphenyl)propane and polyoxyethylene(2.2)-2,2-bis(4-hydroxyphenyl)propane, ethylene glycol, 1,2-propylene glycol, 1,4-butanediol, neopentyl glycol, polyethylene glycol, polypropylene glycol, bisphenol A, hydrogenated bisphenol A, and the like.

The trihydric or higher polyhydric alcohol includes, for instance, sorbitol, pentaerythritol, glycerol, trimethylolpropane, and the like.

In addition, the dicarboxylic acid compound includes, for instance, dicarboxylic acids such as maleic acid, fumaric acid, phthalic acid, isophthalic acid, terephthalic acid, adipic acid, and succinic acid; a substituted succinic acid of which substituent is an alkyl group having 1 to 20 carbon atoms or an alkenyl group having 2 to 20 carbon atoms, such as tetrapropenylsuccinic acid, n-dodecenylsuccinic acid, isododecenylsuccinic acid, n-dodecylsuccinic acid, isooctenylsuccinic acid and isooctylsuccinic acid; acid anhydrides thereof or lower alkyl(1 to 3 carbon atoms) esters thereof; and the like.

The tricarboxylic or higher polycarboxylic acid compound includes, for instance, 1,2,4-benzenetricarboxylic acid (trimellitic acid), 2,5,7-naphthalenetricarboxylic acid, pyromellitic acid, acid anhydrides thereof, lower alkyl(1 to 3 carbon atoms) esters thereof, and the like.

The polyester can be prepared by, for instance, polycondensation of a polyhydric alcohol and a polycarboxylic acid compound under reduced pressure at a temperature of 180° to 250° C. in an inert gas atmosphere in the presence of an esterification catalyst as desired.

It is preferable that the polyester has an acid value of from 0.5 to 60 mg KOH/g, from the viewpoints of the dispersibility of the metal oxide and the transferability, and that the polyester has a hydroxyl value of from 1 to 60 mg KOH/g. In addition, the polyester has a softening point of preferably from 90° to 160° C., more preferably from 100° to 140° C., from the viewpoints of the fixing ability and the durability. Also, it is preferable that the polyester has a glass transition point of from 50° to 85° C.

The toner of the present invention may appropriately contain an additive such as a charge control agent, a releasing agent, a fluidity improver, an electric conductivity modifier, an extender, a reinforcing filler such as a fibrous substance, an antioxidant, an anti-aging agent, and a cleanability improver, in addition to the resin binder, the black colorant, and the external additive.

The toner of the present invention is prepared by a surface treatment step comprising mixing an untreated toner with an external additive using a Henschel mixer or the like. The untreated toner may be any of a pulverized toner, a toner obtained by a phase inversion method and the like. The untreated toner is preferably a pulverized toner, and obtained by, for instance, homogeneously mixing a resin binder, a black colorant and the like in a mixer such as a Henschel mixer or a ball-mill, thereafter melt-kneading with a closed kneader, a single-screw or twin-screw extruder, or the like, cooling, roughly pulverizing the resulting product using a hammer-mill, and further finely pulverizing with a fine pulverizer utilizing a jet stream or a mechanical pulverizer, and classifying the pulverized product to a given particle size with a classifier utilizing rotary stream or a classifier utilizing Coanda effect. The toner has a volume-average particle size of preferably from 3 to 15 μm.

It is preferable that the toner of the present invention which is effective for preventing wear of photoconductor is used in an electrophotographic system in which the developing member is in contact with the photoconductor in a developing step. In the electrophotographic system, wear of photoconductor is likely to be caused. In this case, the effect of preventing wear of photoconductor is more effectively exhibited by using the toner of the present invention.

The nonmagnetic black toner of the present invention is especially suitably used for reversal development which requires a property for developing thin line because wear of photoconductor is reduced so that the image density is uniform. Incidentally, in the present invention, the term "nonmagnetic toner" refers to a paramagnetic material, a diamagnetic material, or a magnetic material having a saturation magnetization of 10 $Am^2/kg$ or less, preferably 2.5 $Am^2/kg$ or less.

Further, since the metal oxide in the present invention has resistivity similar to those of the resistance of colorants such as yellow, cyan and magenta, the nonmagnetic black toner of the present invention can also be suitably used in the formation of full-color fixed images.

EXAMPLES

[Average Particle Size of Metal Oxide]

The number-average particle size is determined by measuring from an electron micrograph.

[Oil Absorption (ml/100 g) of Metal Oxide]

The oil absorption of linseed is determined by a method according to JIS K 5101.

[Specific Surface Area ($m^2$/100 g) of Metal Oxide]

The specific surface area is determined by the nitrogen adsorption method (BET method).

[Acid Value and Hydroxyl Value of Resin]

The acid value and the hydroxyl value are determined by a method according to JIS K 0070.

[Glass Transition Point of Resin]

The glass transition point is determined using a differential scanning calorimeter "DSC 210" (commercially available from Seiko Instruments, Inc.) with raising the temperature at a rate of 10° C./min.

[Softening Point of Resin]

The softening point refers to a temperature at which a half of the resin or the toner flows out, when measured by using a flow tester of the "koka" type "CFT-500D" (commercially available from Shimadzu Corporation) (sample: 1 g, rate of raising temperature: 6° C./min, load: 1.96 MPa, and nozzle: $\phi$1 mm×1 mm).

[Weight-Average Molecular Weight of Resin]

The weight-average molecular weight is determined by the GPC Method (column: GMHLX+G3000HXL (commercially available from Tosoh Corporation), standard sample: monodispersed polystyrene).

Resin Preparation Example

The amount 34.9 parts by weight of a propylene oxide (2.2 moles) adduct of bisphenol A, 32.4 parts by weight of an ethylene oxide (2.2 moles) adduct of bisphenol A, 25.3 parts by weight of isophthalic acid, 3.4 parts by weight of isooctenylsuccinic acid, 3.9 parts by weight of trimellitic acid and 0.1 parts by weight of dibutyltin oxide were reacted at 210° C. under a nitrogen gas stream with stirring. The reaction was terminated when the softening point determined according to ASTM D36-86 reached 130° C. The resulting resin was a pale yellow solid and had a glass transition point of 65° C., an acid value of 18 mg KOH/g and a hydroxyl value of 35 mg KOH/g. This resin is referred to as "Resin A."

Examples 1 to 8 and Comparative Examples 1 and 2

One-hundred parts by weight of Resin A, 10 parts by weight of a metal oxide "Dye Pyroxide Black No. 2" (commercially available from DAINICHISEIKA COLOR & CHEMICALS MFG. CO., LTD., average particle size: 0.01 $\mu$m, oil absorption: 0.0039 ml/$m^2$, major metals contained: Fe, Mn, Cu), 1 part by weight of a charge control agent "BONTRON S-34" (commercially available from Orient Chemical Co., Ltd.) and 1 part by weight of a polypropylene wax "NP-055" (commercially available from MITSUI CHEMICALS, INC.) were supplied into a Henschel Mixer, and mixed with stirring at a mixer temperature of 40° C. for 3 minutes, to give a mixture. The resulting mixture was melt-kneaded at 100° C. with a continuous twin-screw kneader, to give a kneaded product. The kneaded product was then cooled in the air, roughly pulverized and finely pulverized. Thereafter, the resulting product was classified, to give a black powder having a volume-average particle size of 8.5 $\mu$m.

One-hundred parts by weight of the black powder and an external additive as shown in Table 2 were mixed with stirring for 3 minutes with a Henschel mixer, to give a black toner.

Example 9

The same procedures were carried out as in Example 1 except that 100 parts by weight of a styrene(St)-butyl methacrylate(BMA) copolymer resin (weight-average molecular weight: 67,000, St/BMA (molar ratio): 65/35, softening point: 143° C., glass transition point: 64° C.) were used in place of Resin A, to give a black toner.

Example 10

The same procedures were carried out as in Example 1 except that 10 parts by weight of "MC-7" (commercially available from MITSUI MINING & SMELTING CO., LTD., average particle size: 0.02 $\mu$m, oil absorption: 0.0130 ml/$m^2$, major metals contained: Fe, Mn) were used as the metal oxide in place of "Dye Pyroxide Black No. 2," to give a black toner.

Example 11

The same procedures were carried out as in Example 6 except that 10 parts by weight of "MC-10" (commercially available from MITSUI MINING & SMELTING CO., LTD., average particle size: 0.1 $\mu$m, oil absorption: 0.0123 ml/$m^2$, major metals contained: Mg, Al, Fe) were used as the metal oxide in place of "Dye Pyroxide Black No. 2," to give a black toner.

Reference Example 1

The same procedures were carried out as in Example 6 except that 4 parts by weight of a carbon black, "Mogul L" (commercially available from Cabonet Speciality Chemicals Inc.) were used in palace of the metal oxide, to give a black toner.

Reference Example 2

The same procedures were carried out as in Comparative Example 1 except that 4 parts by weight of a carbon black, "Mogul L" (commercially available from Cabonet Speciality Chemicals Inc.) were used in palace of the metal oxide, to give a black toner.

The details of the external additives used in Examples and Comparative Examples are shown in Table 1.

TABLE 1

| External Additive | Material | Agent for Hydrophobic Treatment |
|---|---|---|
| RY-50 (commercially available from Nippon Aerosil) | Hydrophobic Silica | Dimethylsiloxane |
| STT-30A (commercially available from Titan Kogyo K.K.) | Hydrophobic Titania | Silane Coupling Agent |
| P-017 (commercially available from NIPPON PAINT CO., LTD.) | Polymer (MMA-BA Copolymer) | — |
| R-972 (commercially available from Nippon Aerosil Co., Ltd.) | Hydrophobic Silica | Dimethyldichlorosilane |
| AL-45-1 (commercially available from SHOWA DENKO K.K.) | Alumina | — |
| AL-45-2 (commercially available from SHOWA DENKO K.K.) | Alumina | — |
| TAF-1500 (commercially available from Fuji Titanium Industry Co., Ltd.) | Titania (Anatase-type) | — |
| R-976 (commercially available from Nippon Aerosil Co., Ltd.) | Hydrophobic Silica | Dimethyldichlorosilane |
| TSX-3 (commercially available from Shin-Etsu Chemical Co., Ltd.) | Hydrophobic Silica Hydrophobic Titania | Hexamethyldisilazane |
| AL-45-H (commercially available from SHOWA DENKO K.K.) | Alumina | — |

Test Example 1

Each of the toners was loaded onto a digital composite machine "V-940" (commercially available from Murata Machinery, LTD.) in which the developing member was in contact with the photoconductor. The amount of wear of the photoconductor was determined after 10000 sheets of images were printed at a printing ratio of 5%. The amount of wear of photoconductor is evaluated by the following evaluation criteria. The results are shown in Table 2.

[Evaluation Criteria]

The amount of wear of photoconductor per 1000 sheets is:

◎: less than 0.1 μm, especially excellent;

○: 0.1 μm or more and less than 0.2 μm, excellent for practical use;

Δ: 0.2 μm or more and less than 0.35 μm, the minimal level for practical use; and X : 0.35 μm or more, not preferable for practical use.

TABLE 2

| | Colorant | External Additive (Average Particle Size)/Amount Used | Amount of Wear of Photoconductor |
|---|---|---|---|
| Ex. 1 | Metal Oxide | RY-50 (40 nm)/ 1.2 parts by weight | ○ (0.12) |
| Ex. 2 | Metal Oxide | STT-30A (30 mn)/ 1.2 parts by weight | ○ (0.18) |
| Ex. 3 | Metal Oxide | P-017 (70 nm)/ 0.4 parts by weight<br>R-972 (16 nm)/ 0.8 parts by weight | Δ (0.21) |
| Ex. 4 | Metal Oxide | AL-45-1 (1.8 μm)/ 1.2 parts by weight | ○ (0.19) |
| Ex. 5 | Metal Oxide | AL-45-2 (2.1 μm)/ 1.2 parts by weight | Δ (0.27) |
| Ex. 6 | Metal Oxide | RY-50 (40 nm)/ 1.2 parts by weight<br>R-972 (16 nm)/ 0.8 parts by weight | ◎ (0.08) |
| Ex. 7 | Metal Oxide | TAF-1500 (50 nm)/ 0.5 parts by weight<br>R-976 (8 nm)/ 1.0 part by weight | ◎ (0.09) |
| Ex. 8 | Metal Oxide | TSX-3 (0.1 μm)/ 1.2 parts by weight | ○ (0.12) |
| Ex. 9 | Metal Oxide | RY-50 (40 nm)/ 1.2 parts by weight | ○ (0.19) |
| Ex. 10 | Metal Oxide | RY-50 (40 nm)/ 1.2 parts by weight | ○ (0.17) |
| Ex. 11 | Metal Oxide | RY-50 (40 nm)/ 1.2 parts by weight<br>R-972 (16 nm)/ 0.8 parts by weight | ◎ (0.07) |
| Comp. Ex. 1 | Metal Oxide | R-972 (16 nm)/ 1.2 parts by weight | X (0.41) |
| Comp. Ex. 2 | Metal Oxide | AL-45-H (3.0 μm)/ 1.2 parts by weight | X (0.48) |
| Ref. Ex. 1 | Carbon Black | RY-50 (40 nm)/ 1.2 parts by weight<br>R-972 (16 nm)/ 0.8 parts by weight | X (0.44) |
| Ref. Ex. 2 | Carbon Black | R-972 (16 nm)/ 1.2 parts by weight | —<br>(Filming generated) |

It is seen from the above results that the black toners of Examples 1 to 11 are more effective for reducing wear of photoconductor, as compared to Comparative Examples 1 and 2 in which an external additive having an average particle size outside the desired range is used. In addition, it is seen from the results of Reference Examples 1 and 2 in which a carbon black is used in place of a metal oxide that the effect of reducing wear of photoconductor with the external additive having a large particle size is a special effect exhibited when used in combination with the metal oxide.

According to the present invention, there can be provided a nonmagnetic black toner which comprise a metal oxide as a black colorant but can reduce wear of photoconductor.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A nonmagnetic black toner comprising:

a resin binder, a black colorant comprising a metal oxide, wherein the metal oxide has an oil absorption per unit area of 0.07 $ml/m^2$ or less and the content of the metal oxide is from 1 to 30 parts by weight, based on 100 parts by weight of the resin binder, and externally-added fine particles having an average particle size of 30 nm to 2.1 $\mu$m, wherein the fine particles are contained in the toner in an amount of 0.2% by weight or more.

2. The nonmagnetic black toner according to claim 1, wherein the fine particles are obtained by subjecting an oxide containing at least one metal selected from the group consisting of silicon (Si), titanium (Ti) and aluminum (Al) to a hydrophobic treatment.

3. The nonmagnetic black toner according to claim 1, further comprising an externally-added silica having an average particle size of less than 20 nm.

4. The nonmagnetic black toner according to claim 1, wherein at least one metal constituting the metal oxide is an element selected from the group consisting of magnesium (Mg), aluminum (Al), manganese (Mn), iron (Fe) and copper (Cu).

5. The nonmagnetic black toner according to claim 1, wherein the metal oxide has an average particle size of from 5 nm to 1 $\mu$m.

6. A process for development of a toner, comprising placing the nonmagnetic black toner of claim 1 into an electrophotographic device in which a developing member is in contact with a photoconductor.

7. A method for developing an image comprising placing the nonmagnetic black toner according to claim 1 into an electrophotographic device in which a developing member is in contact with a photoconductor and developing the image in a development step.

* * * * *